US007266854B1

(12) United States Patent
Gomez

(10) Patent No.: US 7,266,854 B1
(45) Date of Patent: Sep. 11, 2007

(54) GYPSUM BOARD CUTTING TOOL

(76) Inventor: Carlos Gomez, 11306 Evans Trial Apartment 4, Beltsville, MD (US) 20705

( * ) Notice: Subject to any disclaimer, the term of this patent is extended or adjusted under 35 U.S.C. 154(b) by 0 days.

(21) Appl. No.: 11/406,140

(22) Filed: Apr. 19, 2006

(51) Int. Cl.
*B26B 11/00* (2006.01)
*B25D 1/00* (2006.01)

(52) U.S. Cl. ..... 7/163; 7/119; 7/144; 30/123; 30/162

(58) Field of Classification Search ..... 7/163, 7/164, 144, 105, 119, 158; 30/162, 123, 30/125
See application file for complete search history.

(56) References Cited

U.S. PATENT DOCUMENTS 2,215,216 A * 9/1940 Gits et al. ..... 30/125
3,927,432 A 12/1975 Dahi
4,255,856 A * 3/1981 Mackie ..... 30/293
4,620,369 A 11/1986 Grecken
4,761,882 A * 8/1988 Silverstein ..... 30/162
4,974,320 A * 12/1990 Pelletier ..... 7/158
4,993,093 A * 2/1991 Goldwitz ..... 7/163
5,063,627 A 11/1991 Marra
5,119,521 A 6/1992 Clontz
5,206,965 A * 5/1993 Rowley ..... 7/119
5,289,637 A * 3/1994 Coffey ..... 30/294
5,349,760 A 9/1994 De Vito
5,603,162 A * 2/1997 Chen ..... 30/162
D394,792 S 6/1998 Bourque
5,956,799 A * 9/1999 Panaccione et al. ..... 81/177.1
5,966,817 A * 10/1999 Lee ..... 30/162
6,279,876 B1 8/2001 Massie
6,298,562 B1 * 10/2001 Duquette ..... 30/162
6,367,154 B2 * 4/2002 Degabli ..... 30/162
6,951,055 B1 * 10/2005 Collins ..... 30/125

* cited by examiner

*Primary Examiner*—Hadi Shakeri

(57) ABSTRACT

A combined tool includes a cutting tool that has a housing including a pair of conjoined shells. Each shell has a U-shaped notch formed at a distal end thereof that form a rectangular opening when the shells are abutted. Each shell has an interior groove formed therein that creates a storage chamber after the shells are abutted. A fastener is inserted through the shells. A plastic cap is connected to proximal ends of the shells. A measuring tape has a housing and an extendable and retractable body housed therein that has a rigid stop member coupled thereto. The stop member is vertically interfitted into the opening and remains spaced from the storage chamber so the user can maintain a continuous line of sight into the storage chamber while the body is engaged with the opening. The measuring tape and the cutting tool travel in sync during cutting procedures.

18 Claims, 3 Drawing Sheets

GYPSUM BOARD CUTTING TOOL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cutting tools and, more particularly, to a gypsum board cutting tool for assisting a user to quickly and effectively cut a gypsum wall board along an axial path.

2. Prior Art

In the installation of gypsum board panels, knives are used to cut appropriately sized panels and their associated joints. Typically, a blade of the drywall knife is riveted or otherwise permanently attached to a handle which provides a convenient grip for holding and using the knife. Due to this permanent connection between the blade and handle, the blade normally cannot be replaced. Consequently, different blades cannot be interchanged with different handles, and the entire knife, including the handle, must be discarded when the blade is bent or otherwise damaged.

Furthermore, when preparing gypsum board panels, a person must make multiple markings along one surface of the panel and then connect such markings to create a reference line along which the panel can be cut. This, obviously, is a rather time consuming process, especially in instances where the panels are exceptionally long. Furthermore, the markings made by the person may form dents in the panel surface that must later be covered to maintain an aesthetically appealing appearance of the gypsum board. Again, such procedures only add time and effort to the process of installing gypsum board panels.

Tools equipment with integral measuring devices are known in the prior art. One example discloses a tape measure that is installed within the handle of a hand tool, like a hammer. The assembly includes a gearing connection between the tape and a retracting spring, which enables the assembly to be elongated in conformity with the tool handle. When the hand tool is used, the tape measure is always present when needed. Unfortunately, the orientation of the tape measure with respect to the tool prevents the tape measure and tool from being simultaneously used. This is not desirable for gypsum board installation, as is mentioned herein above.

Accordingly, a need remains for a gypsum board cutting tool in order to overcome the above-noted shortcomings. The present invention satisfies such a need by providing a cutting tool assembly that is convenient and easy to use, provides accurate cuttings, saves time and energy, is cost-effective, and results in an improved job quality. A worker no longer has to spend a considerable amount of time pre-measuring and pre-marking a panel of gypsum board for cutting purposes. Instead, all the necessary tools are unified into one unit that allows measurements and cuts to be made simultaneously or independently. Both trades-people and do-it-yourself enthusiasts can advantageously use the cutting tool for a variety of projects due to the versatility thereof.

BRIEF SUMMARY OF THE INVENTION

In view of the foregoing background, it is therefore an object of the present invention to provide a gypsum board cutting tool. These and other objects, features, and advantages of the invention are provided by a combined cutting and measuring tool for assisting a user to quickly and effectively cut a gypsum wall board along an axial path.

The combined cutting and measuring tool includes a cutting tool that has a bifurcated housing including a pair of coextensively shaped shells directly and removably conjoined along a center of the cutting tool. Each of the shells has a U-shaped notch formed at a distal end thereof such that the U-shaped notches effectively form a rectangular opening at a distal end of the cutting tool when the shells are abutted against each other. Such a rectangular opening preferably extends parallel to the longitudinal axis of the cutting tool. The shells also have a corrugated bottom edge disposed adjacent to a distal of the cutting tool.

Each of the shells further has an interior groove formed therein that conveniently create a storage chamber inside the cutting tool after the shells are directly abutted together. Such a cutting tool further has a fastener threadably inserted through each of the shells. The fastener is oriented parallel to the body.

A cap is directly connected to proximal ends of the shells respectively. Such a cap is formed from plastic material and further is removably attached to the shells such that the user can advantageously and conveniently inspect the storage chamber through the proximal end while the shells are coupled to each other.

A measuring tape has a housing and a flexible wound body partially housed therein. Such a body has a rigid stop member directly coupled to a distal end thereof. The stop member is removably interfitted directly into the rectangular opening such that the body is effectively registered orthogonal to a longitudinal axis of the cutting tool. The rectangular opening may have a longitudinal length greater than a longitudinal length of the stop member.

Such a stop member is inserted vertically downward into the rectangular opening and remains distally spaced from the storage chamber so that the user can conveniently and effectively maintain a continuous line of sight directly into the storage chamber while the body is engaged with the rectangular opening. The body is extendable and retractable while the distal end engages with the rectangular opening and maintains a static relationship with the cutting tool so that the measuring tape and the cutting tool travel in sync along the gypsum board while the cutting tool slices the gypsum board. The body preferably has a longitudinal length registered orthogonal to the longitudinal length of the rectangular opening.

The assembly may further include a plurality of blades housed within the storage chamber. One of the blades is partially exposed from the distal end of the cutting tool. Such blades may be coextensively shaped.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
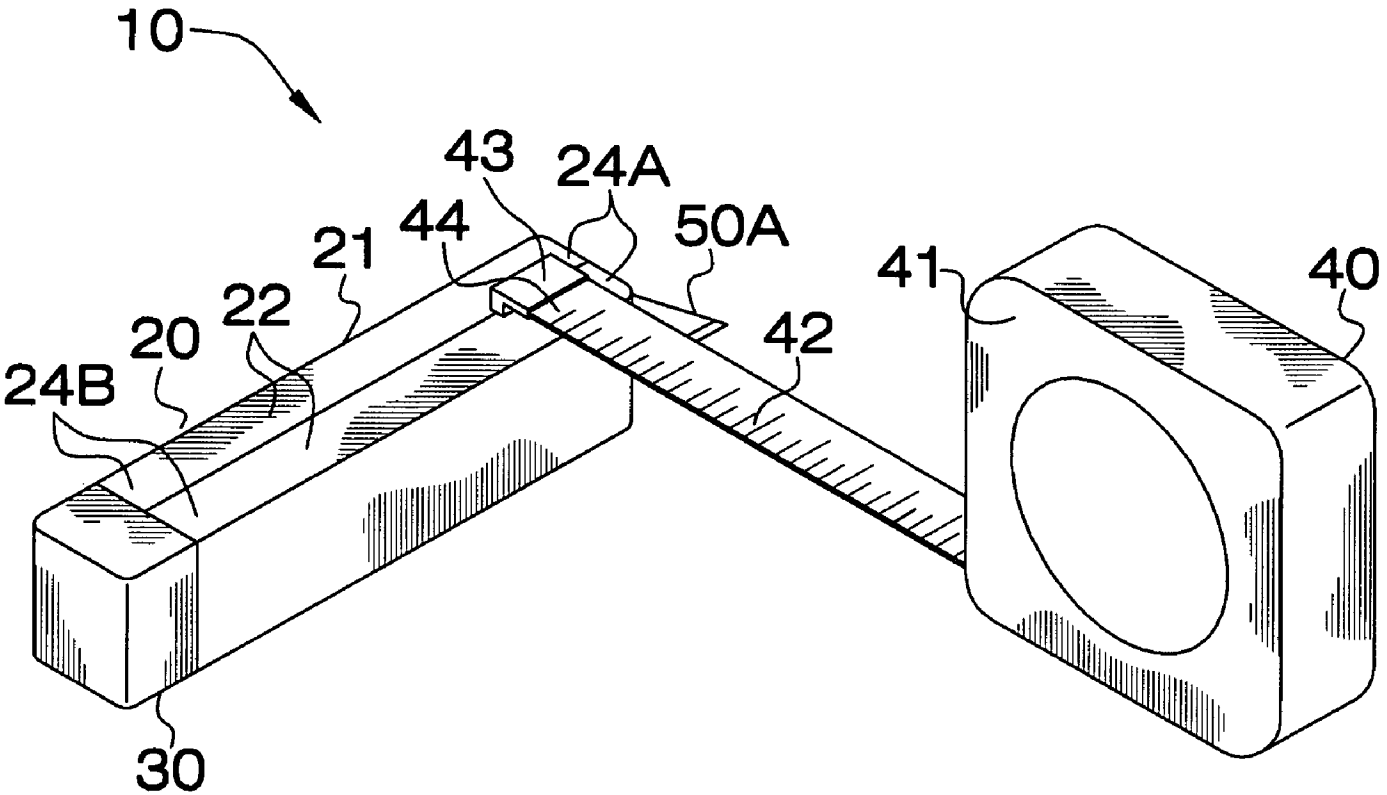
FIG. 1 is a perspective view showing a combination gypsum board cutting tool and tape measure, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-6 by the reference numeral 10 and is intended to provide a gypsum board cutting tool. It should be understood that the apparatus 10 may be used to measure and cut many different types of materials and should not be limited in use to only measuring and cutting gypsum board.

Figure 3:
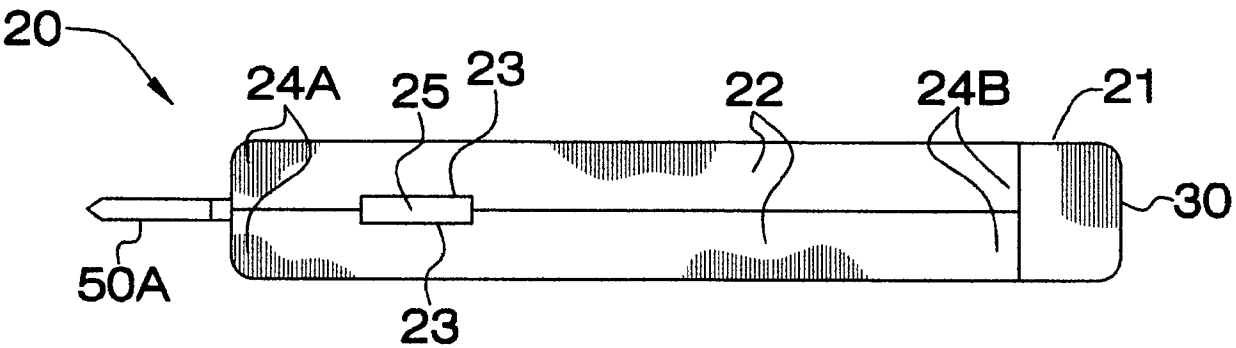
FIG. 3 is a top plan view of the cutting tool shown in FIG. 2, taken along line 3-3.

Initially referring to FIGS. 1, 2, 3, 4, 5 and 6, the assembly 10 includes a cutting tool 20 that has a bifurcated housing 21 including a pair of coextensively shaped shells 22 directly and removably conjoined, without the use of intervening elements, along a center of the cutting tool 20. Of course, the cutting tool 20 may be produced in a variety of different shapes and sizes, as is obvious to a person of ordinary skill in the art. Each of the shells 22 has a U-shaped notch 23 formed at a distal end 24A thereof such that the U-shaped notches 23 effectively form a rectangular opening 25 at a distal end 24A of the cutting tool 20 when the shells 22 are abutted against each other. Such a rectangular opening 25 extends parallel to the longitudinal axis of the cutting tool 20, as is best shown in FIG. 3.

Figure 2:
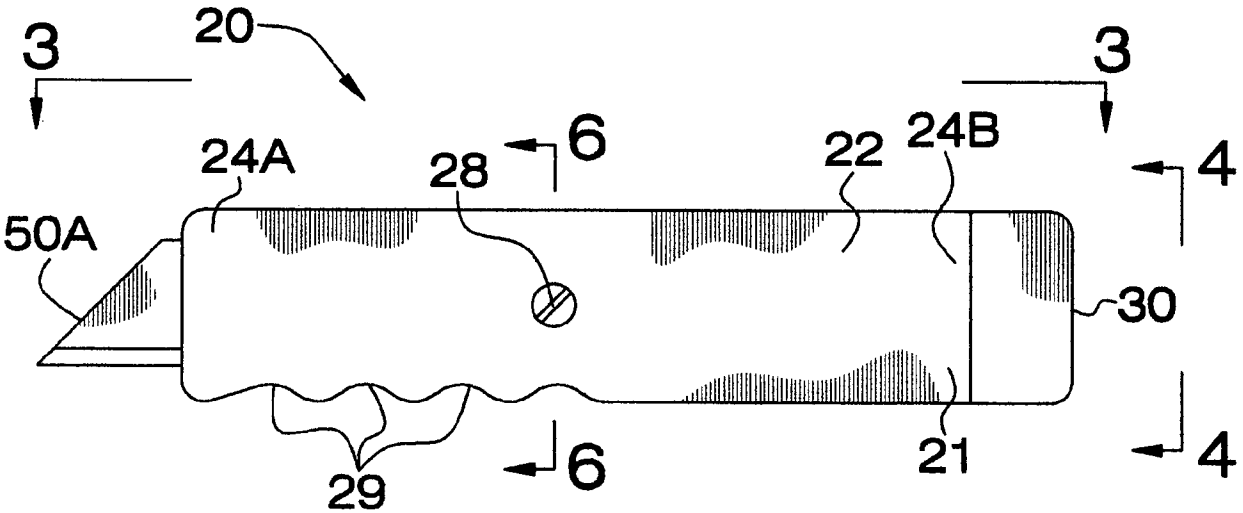
FIG. 2 is a side-elevational view of the cutting tool shown in FIG. 1.
Figure 5:
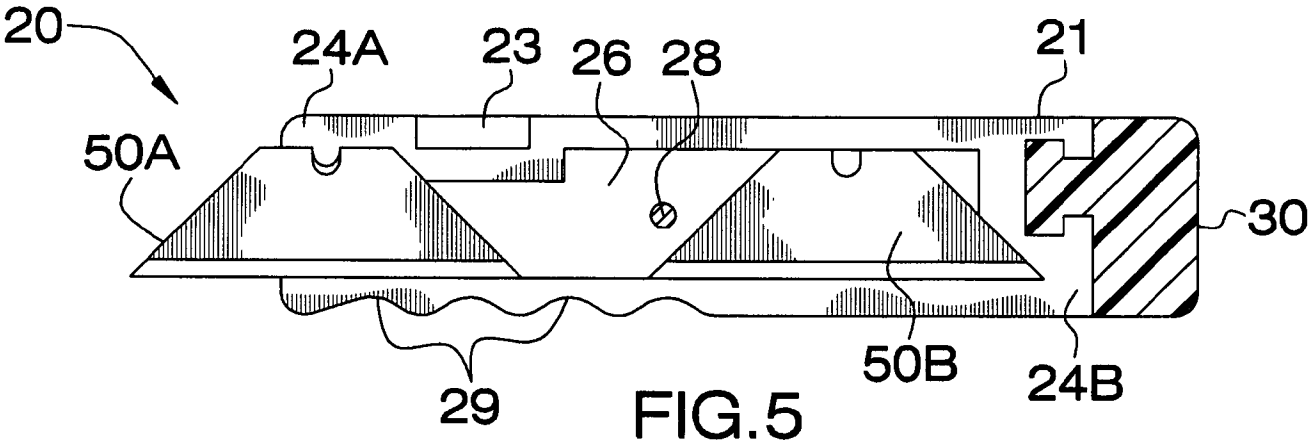
FIG. 5 is a cross-sectional view of the cutting tool shown in FIG. 4, taken along line 5-5 and showing the interior groove of the shells.
Figure 6:
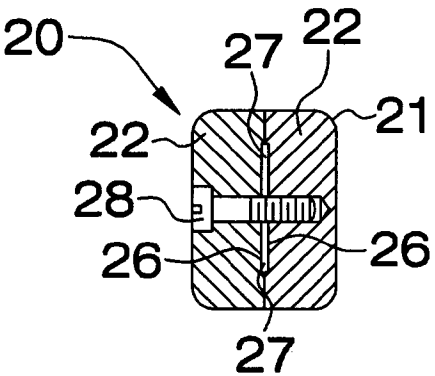
FIG. 6 is a cross-sectional view of the cutting tool shown in FIG. 2; showing the threaded fastener positioned therethrough.
Figure 4:
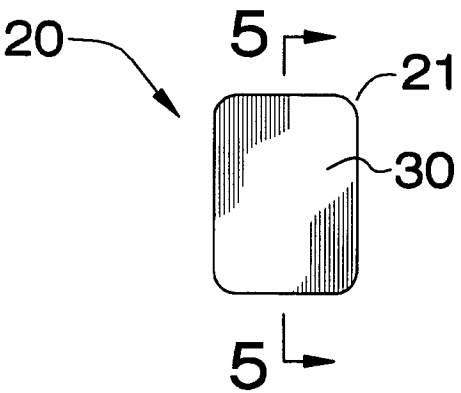
FIG. 4 is a rear-elevational view of the cutting tool shown in FIG. 2, taken along line 4-4.

Referring to FIGS. 2, 5 and 6, each of the shells further has an interior groove 26 formed therein that conveniently creates a storage chamber 27 inside the cutting tool 20 after the shells 22 are directly abutted together, without the use of intervening elements. Such a cutting tool 20 further has a fastener 28 threadably inserted through each of the shells 22, which is essential for statically connecting the shells 22 of the bifurcated housing 21. The fastener 28 is oriented parallel to the body 42 (described herein below). The shells 22 also have a corrugated bottom edge 29 disposed adjacent to a distal end 24A of the cutting tool 20. Such a corrugated bottom edge 29 is important and advantageous for providing a convenient surface along which a user's metacarpals can grip the assembly 10, allowing the user to comfortably manipulate the cutting tool 20 during operating procedures.

Referring to FIGS. 1 through 5, a cap 30 is directly connected, without the use of intervening elements, to proximal ends 24B of the shells 22 respectively. Such a cap 30 is formed from plastic material and further is removably attached to the shells 22, which is crucial such that the user can advantageously and conveniently inspect the storage chamber 27 through the proximal end 24B while the shells 22 are coupled to each other. The cap 30 can also conveniently function as a striking surface with which the user can dislodge two panels of gypsum board that are cut from a solid initial panel of gypsum board, in the event that the blade 50 (described herein below) does not completely sever the initial panel in two.

Referring to FIG. 1, a measuring tape 40 has a housing 41 and a flexible wound body 42 partially housed therein. Of course, the body 42 may be produced in a variety of alternate lengths, having English and/or Metric measurement markings, depending on the particular needs of the user, as is obvious to a person of ordinary skill in the art. Such a body 42 has a rigid stop member 43 directly coupled, without the use of intervening elements, to a distal end 44 thereof. The stop member 43 is removably interfitted directly, without the use of intervening elements, into the rectangular opening 25, which is crucial such that the body 42 is effectively registered orthogonal to a longitudinal axis of the cutting tool 20. The rectangular opening 25 has a longitudinal length greater than a longitudinal length of the stop member 43.

Still referring to FIG. 1, such a stop member 43 is inserted vertically downward into the rectangular opening 25 and remains distally spaced from the storage chamber 27, which is vital so that the user can conveniently and effectively maintain a continuous line of sight directly into the storage chamber 27 while the body 42 is engaged with the rectangular opening 25. The body 42 is effectively extendable and retractable while the distal end 44 is engaged with the rectangular opening 25 and maintains a static relationship with the cutting tool 20, which is important so that the measuring tape 40 and the cutting tool 20 advantageously travel in sync along the gypsum board while the cutting tool 20 slices the gypsum board. The body 42 has a longitudinal length registered orthogonal to the longitudinal length of the rectangular opening 25.

Referring to FIGS. 1, 2, 3 and 5, the assembly 10 further includes a plurality of blades 50 housed within the storage chamber 27. One 50A of the blades 50 is partially exposed from the distal end 24A of the cutting tool 20. Another one 50B of the blades 50 is completely disposed within the chamber 27, which is critical for advantageously ensuring that a sharp new blade 50 is readily available should the one blade 50A become dull or damaged due to repeated use.

In use, the assembly 10 operator extends the body 42 to a desired length and locks the body 42 in place. Subsequently, the stop member 43 is vertically and downwardly inserted into the rectangular opening 25. The cutting tool 20 and the tape measure 40 are then simultaneously pulled across the work surface along a desired edge. Thus, the one blade 50A cuts through the material, preferably a panel of gypsum board, as the assembly 10 is across a surface thereof. The material stock is thus advantageously and exactly cut where the user whishes it to be cut without having to make superfluous and time-consuming measurements and markings. Of course, the assembly 10 may be used to cut any suitable stock material, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined cutting and measuring tool for assisting a user to quickly and effectively cut a gypsum wall board along an axial path, said combined cutting and measuring tool comprising:

a cutting tool having a bifurcated housing including a pair of coextensively shaped shells directly and removably conjoined along a center of said cutting tool, each of said shells having a U-shaped notch formed at a distal end thereof such that said U-shaped notches form a rectangular opening at a distal end of said cutting tool when said shells are abutted against each other, each of said shells further having an interior groove formed therein that create a storage chamber inside said cutting tool after said shells are directly abutted together;

a cap directly connected, without the use of intervening elements, to proximal ends of said shells respectively, said cap being formed from plastic material and further being removably attached to said shells such that the user can inspect said storage chamber through said proximal end while said shells are coupled to each other; and a measuring tape having a housing and a flexible wound body partially housed therein, said body having a rigid stop member directly coupled to a distal end thereof;

wherein said stop member is removably interfitted directly into said rectangular opening such that said body is registered orthogonal to a longitudinal axis of said cutting tool, said body being extendable and retractable while said distal end engages with said rectangular opening and maintains a static relationship with said cutting tool so that said measuring tape and said cutting tool travel in sync along the gypsum board while said cutting tool slices the gypsum board.

2. The assembly of claim 1, further comprising:

a plurality of blades housed within said storage chamber, one of said blades being partially exposed from said distal end of said cutting tool.

3. The assembly of claim 1, wherein said rectangular opening extends parallel to the longitudinal axis of said cutting tool.

4. The assembly of claim 1, wherein said rectangular opening has a longitudinal length greater than a longitudinal length of said stop member.

5. The assembly of claim 1, wherein said shells have a corrugated bottom edge disposed adjacent to a distal end of said cutting tool.

6. The assembly of claim 1, wherein said body has a longitudinal length registered orthogonal to the longitudinal length of said rectangular opening.

7. A combined cutting and measuring tool for assisting a user to quickly and effectively cut a gypsum wall board along an axial path, said combined cutting and measuring tool comprising:

a cutting tool having a bifurcated housing including a pair of coextensively shaped shells directly and removably conjoined along a center of said cutting tool, each of said shells having a U-shaped notch formed at a distal end thereof such that said U-shaped notches form a rectangular opening at a distal end of said cutting tool when said shells are abutted against each other, each of said shells further having an interior groove formed therein that create a storage chamber inside said cutting tool after said shells are directly abutted together, wherein said cutting tool further has a fastener threadably inserted through each of said shells;

a cap directly connected, without the use of intervening elements, to proximal ends of said shells respectively, said cap being formed from plastic material and further being removably attached to said shells such that the user can inspect said storage chamber through said proximal end while said shells are coupled to each other; and a measuring tape having a housing and a flexible wound body partially housed therein, said body having a rigid stop member directly coupled to a distal end thereof;

wherein said stop member is removably interfitted directly into said rectangular opening such that said body is registered orthogonal to a longitudinal axis of said cutting tool, said body being extendable and retractable while said distal end engages with said rectangular opening and maintains a static relationship with said cutting tool so that said measuring tape and said cutting tool travel in sync along the gypsum board while said cutting tool slices the gypsum board.

8. The assembly of claim 7, further comprising:

a plurality of blades housed within said storage chamber, one of said blades being partially exposed from said distal end of said cutting tool.

9. The assembly of claim 7, wherein said rectangular opening extends parallel to the longitudinal axis of said cutting tool.

10. The assembly of claim 7, wherein said rectangular opening has a longitudinal length greater than a longitudinal length of said stop member.

11. The assembly of claim 7, wherein said shells have a corrugated bottom edge disposed adjacent to a distal end of said cutting tool.

12. The assembly of claim 7, wherein said body has a longitudinal length registered orthogonal to the longitudinal length of said rectangular opening.

13. A combined cutting and measuring tool for assisting a user to quickly and effectively cut a gypsum wall board along an axial path, said combined cutting and measuring tool comprising:

a cutting tool having a bifurcated housing including a pair of coextensively shaped shells directly and removably conjoined along a center of said cutting tool, each of said shells having a U-shaped notch formed at a distal end thereof such that said U-shaped notches form a rectangular opening at a distal end of said cutting tool when said shells are abutted against each other, each of said shells further having an interior groove formed therein that create a storage chamber inside said cutting tool after said shells are directly abutted together, wherein said cutting tool further has a fastener threadably inserted through each of said shells;

a cap directly connected, without the use of intervening elements, to proximal ends of said shells respectively, said cap being formed from plastic material and further being removably attached to said shells such that the user can inspect said storage chamber through said proximal end while said shells are coupled to each other; and a measuring tape having a housing and a flexible wound body partially housed therein, said body having a rigid stop member directly coupled to a distal end thereof;

wherein said stop member is removably interfitted directly into said rectangular opening such that said body is registered orthogonal to a longitudinal axis of said cutting tool, said body being extendable and retractable while said distal end engages with said rectangular opening and maintains a static relationship with said cutting tool so that said measuring tape and said cutting tool travel in sync along the gypsum board while said cutting tool slices the gypsum board;

wherein said stop member is inserted vertically downward into said rectangular opening and remains distally spaced from said storage chamber so that the user can maintain a continuous line of sight directly into said storage chamber while said body is engaged with said rectangular opening.

14. The assembly of claim 13, further comprising:

a plurality of blades housed within said storage chamber, one of said blades being partially exposed from said distal end of said cutting tool.

15. The assembly of claim 13, wherein said rectangular opening extends parallel to the longitudinal axis of said cutting tool.

16. The assembly of claim 13, wherein said rectangular opening has a longitudinal length greater than a longitudinal length of said stop member.

17. The assembly of claim 13, wherein said shells have a corrugated bottom edge disposed adjacent to a distal end of said cutting tool.

18. The assembly of claim 13, wherein said body has a longitudinal length registered orthogonal to the longitudinal length of said rectangular opening.

* * * * *